United States Patent [19]

Cole

[11] 4,189,811

[45] Feb. 26, 1980

[54] METHOD FOR PRODUCING NON-WOVEN WEBS OF CROSS-LAID STRANDS

[75] Inventor: Paul M. Cole, Wilmington, Del.

[73] Assignee: E. I. Du Pont de Nemours and Company, Wilmington, Del.

[21] Appl. No.: 891,400

[22] Filed: Mar. 29, 1978

[51] Int. Cl.[2] ..... D04H 3/04

[52] U.S. Cl. ..... 28/100; 28/101; 66/84 A; 156/439

[58] Field of Search ..... 26/51.3; 28/100, 101; 66/84 A; 156/439, 440

[56] References Cited

U.S. PATENT DOCUMENTS

| | | | |
|---|---|---|---|
| 848,416 | 3/1907 | Voland et al. | 26/51.3 |
| T966,001 | 1/1978 | Forsythe . | |
| 1,358,094 | 11/1920 | Morris . | |
| 2,000,643 | 5/1935 | Morton . | |
| 2,962,080 | 11/1960 | Hirsch . | |
| 3,340,584 | 9/1967 | Kalwaites . | |
| 3,345,231 | 10/1967 | Gidge et al. . | |
| 3,390,439 | 7/1968 | Kalwaites . | |
| 3,390,439 | 7/1968 | Kalwaites . | |
| 3,593,394 | 7/1971 | Bolles . | |
| 3,602,965 | 9/1971 | Burger | 28/101 |
| 3,606,769 | 9/1971 | Walford . | |
| 3,616,067 | 10/1971 | Treckmann . | |
| 3,805,341 | 4/1974 | Jense . | |
| 3,878,591 | 4/1975 | Jense | 28/100 |
| 4,016,631 | 4/1977 | Cole . | |
| 4,030,168 | 6/1977 | Cole . | |
| 4,045,847 | 9/1977 | Walford | 28/101 |
| 4,071,931 | 2/1978 | Niederhauser | 28/101 |

FOREIGN PATENT DOCUMENTS

| | | |
|---|---|---|
| 46-14572 | 4/1971 | Japan . |

*Primary Examiner*—Robert Mackey

[57] ABSTRACT

A restrained web of orthogonal strands is formed by first traversing the strands according to the disclosure of U.S. Pat. No. 4,016,631 in a diagonal pattern with V-shaped reversals between two rows of strand-restraining elements along the selvedge of the web and then converting the diagonal pattern to an orthogonal pattern by forming an extended loop in each strand along the selvedge.

6 Claims, 7 Drawing Figures

N STRANDS
W
L
S
40
16a
16
28
29
26
24
25
22
32

METHOD FOR PRODUCING NON-WOVEN WEBS OF CROSS-LAID STRANDS

DESCRIPTION

1. Technical Field

This invention relates to the formation of a restrained web of orthogonally transverse equally spaced strands. More particularly, it relates to a method of and an apparatus for forming the web from a plurality of strands laid down at high speed.

2. Background Art

Many types of machines have been developed for withdrawing strands from packages and traversing them between substantially parallel moving rows of pins or other restraining elements to form a web which is held by the restraining elements until a desired operation (e.g., reinforcement of a sheet material by the web) is carried out. Particularly desirable is a web having an orthogonal laydown pattern. Machines capable of producing this pattern as well as many other patterns are shown in my U.S. Pat. Nos. 4,016,631 and 4,030,168, in which the orthogonal pattern is achieved by forming a loop in each strand while it is being traversed, the end of each loop being laid down outside the restraining elements parallel to the machine direction of the web while the intervening portions of the strand are laid down at right angles to the machine direction.

For maximum productivity of web formation, it is desirable to lay down numerous strands simultaneously, and to traverse them between the rows of restraining elements as rapidly as feasible. In general, for web-forming machines of a given level of sophistication, a diagonal pattern in which the strands are simply traversed back and forth with a V-shaped reversal at each side can be formed at higher speed than an orthogonal pattern can. In forming the diagonal pattern, each strand forms only a very small loop as it passes around a single restraining element at each side, and a large number of strands can be traversed simultaneously and rapidly in this simple traversing pattern. However, highly objectionable strand cross-overs occur in the web. With the orthogonal lay-down pattern, strand cross-overs in the web can be eliminated but the length of the loop formed in each strand as it is traversed increases as the number of strands traversed is increased. As the number of strands traversed is increased, the loop-forming device becomes more complex; and as the loop becomes longer, the friction involved in forming it increases. Also, as the length of the loop increases, the problems involved in positively positioning the loop on the restraining elements increase, since a long loop is more free to fly around at the moment it is released from the traversing elements than a short loop is. All of these factors tend to restrict the number of strands which can be traversed in an orthogonal pattern or the speed at which they can be traversed. Moreover, in a diagonal pattern, each strand is traversed back and forth at right angles between the two rows of strand-restraining elements; while in an orthogonal pattern, one end of each strand is being traversed at an acute angle. The strand travels a greater distance when traversed at an acute angle, and there is a limit as to how much departure from a right angle is practicable during the traversing operation.

DISCLOSURE OF THE INVENTION

In the present invention, the steps of strand laydown and formation of the loops along each selvedge are separated. The strands are first laid down in a simple diagonal pattern with V-shaped reversals at each side; and the diagonal laydown pattern is then converted to an orthogonal pattern by forming a loop in each strand along the selvedge.

More particularly, according to this invention a new method and apparatus have been developed for use with a machine for cross-laying a plurality of strands into a web on a conveyor to convert an angled pattern laydown to an orthogonal pattern. The method comprises operation of an apparatus that includes a device for traversing a plurality of strands between two spaced conveyors having strand-restraining elements thereon to form a web. Each of the conveyors is comprised of juxtaposed outer and inner rows of strand-restraining elements traveling in separate paths and means are provided for moving the outer row of strand-restraining elements in a devious path from a constant plane and back to the constant plane while the paths of the inner rows of strand-restraining elements remain in said constant plane to cause a location on the outer row of strand-restraining elements to lag behind a similar location on the inner row of strand-restraining elements a predetermined distance. This relative movement brings the strands into the desired orthogonal pattern. The method permits a portion of each strand to pass along the selvedge of the web by sliding around displaced strand-restraining elements. This portion of the strand is made available by an upward bowing of the yarn during laydown over a support located between the conveyors.

BEST MODE

Figure 1:
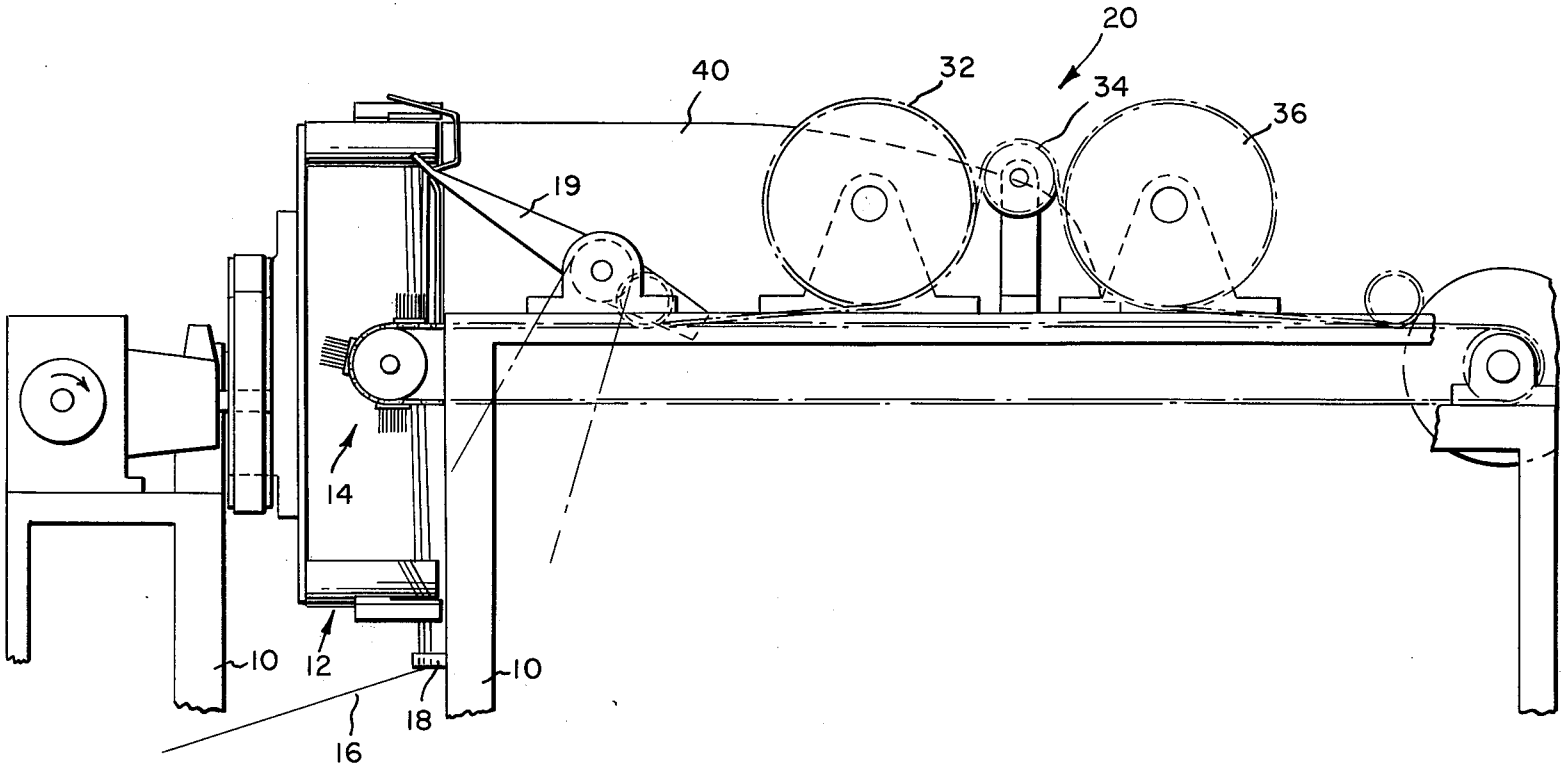
FIG. 1 is a partial side elevational showing the rectification apparatus of this invention coupled with an apparatus for traversing strands.
Figure 2:
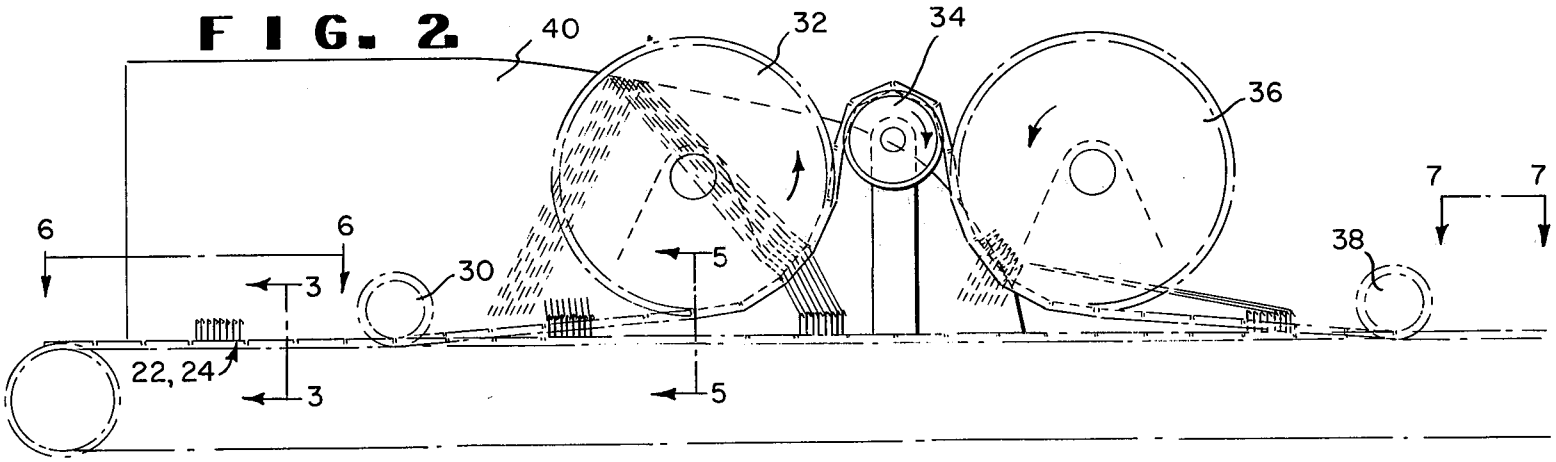
FIG. 2 is an enlarged side elevation of the rectification apparatus of this invention.
Figure 4:
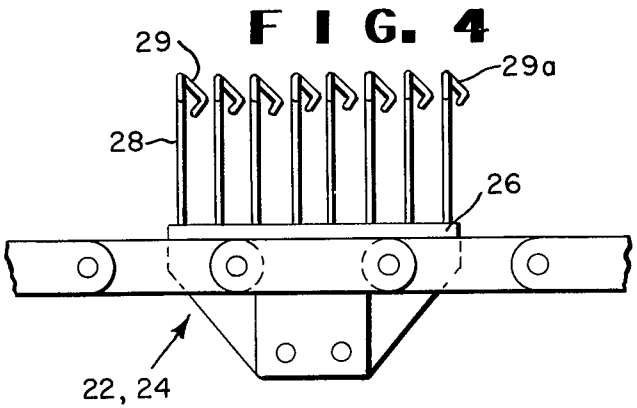
FIG. 4 is a view taken along line 4—4 of FIG. 3.
Figure 3:
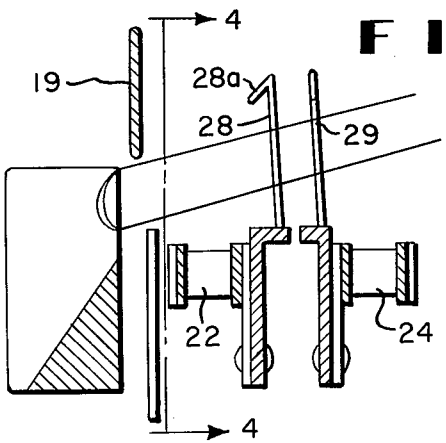
FIG. 3 is a view taken along line 3—3 of FIG. 2.

Referring to FIG. 1, it will be seen that the apparatus for traversing strands chosen for purposes of illustration includes generally, a frame 10, counter rotating arms 12 that orbit selvedge conveyors 14 drawing strands 16 as a loop from a supply through a guide 18 between the conveyors and position the loop around one or more strand-restraining elements on the conveyors. The loop is then released to the strand-restraining elements by a continuously rotating member 19, all as more fully described in my U.S. Pat. No. 4,016,631. The invention involves a modified pin conveyor generally designated 20 and its operation to enable laydown of the strands in a diagonal pattern and the conversion of the V-shaped diagonal pattern to an orthogonal pattern.

As best seen in FIGS. 2–7, the conveyor 20 has two juxtaposed rows of roller chains at each selvedge. The outer row at each selvedge has been designated 22 while the inner row at each selvedge has been designated 24. Each chain has plates 25, 26 carrying strand-restraining elements 28, 29 and intermediate blank spaces. The outer roller chain 22 at each selvedge is trained around driven sprockets 30, 32, 34, 36 and 38 in a devious path while inner roller chain 24 remains in constant plane and consequently a shorter path. The strand-restraining elements 28 associated with the outer roller chain 22 have hook ends 28*a* that are inclined downward and outward while the strand-restraining elements 29 associated with the inner roller chain 24 have hook ends 29*a* that are inclined downward and in the direction of travel. These hook ends prevent strands from escaping during relative movement of the chains 22, 24.

Located between the two selvedges of the conveyor is a baffle plate 40 that serves to accumulate the strands 16 for the purpose of providing a portion of the strand for passing along the selvedge in forming a loop. The baffle or support plate 40 extends from the beginning of the strand laydown on the conveyor to a location just beyond sprocket 34.

Figures 5, 6, 7:
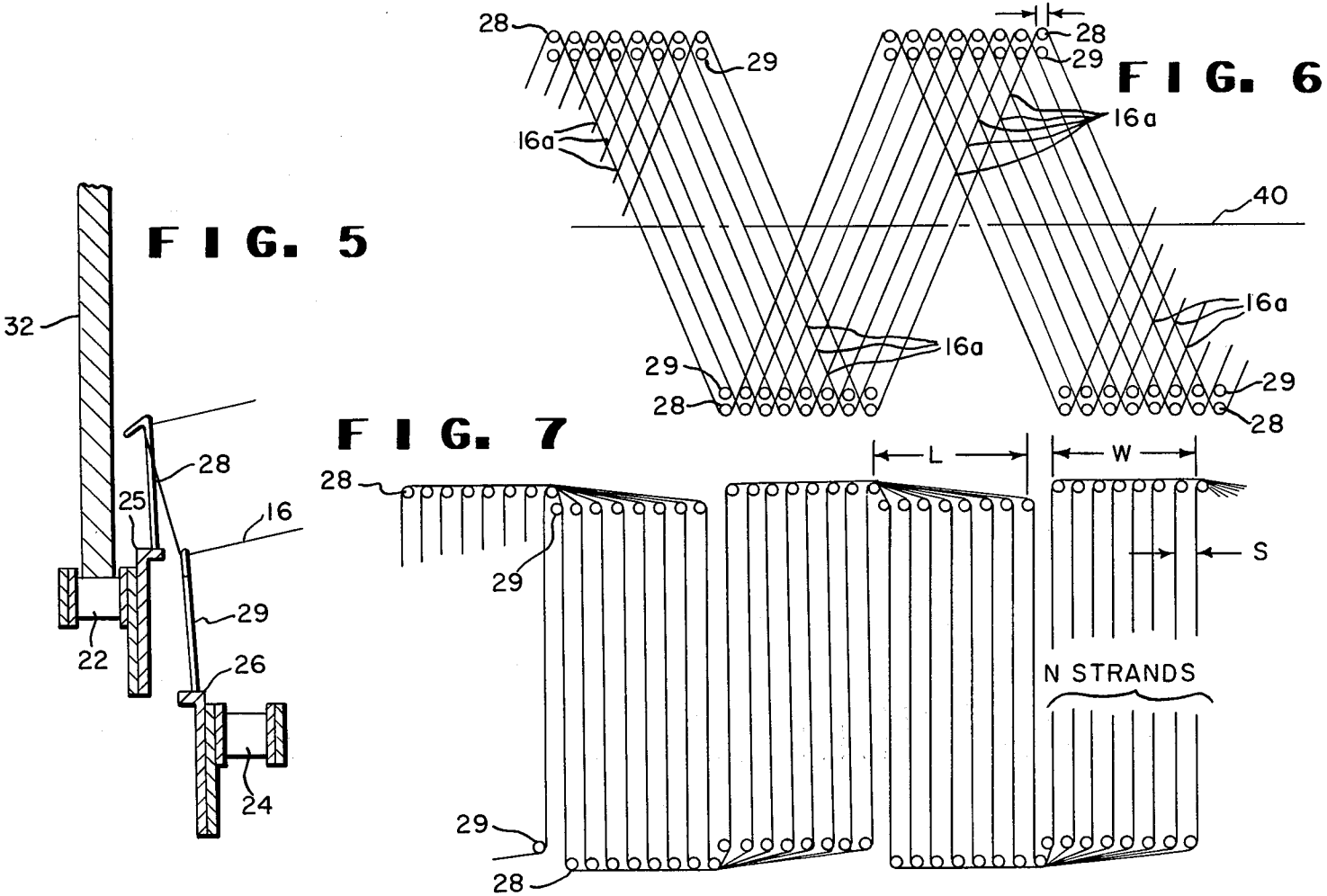
FIG. 5 is a view taken along line 5—5 of FIG. 2.
FIG. 6 is a plan view of FIG. 2 encompassing the area designated by line 6—6.
FIG. 7 is a plan view of FIG. 2 encompassing the area designated by line 7—7.

In general terms of operation as shown in FIGS. 6 and 7, the strands are first laid down over support 40 in a simple diagonal pattern with V-shaped reversals in a predetermined band width W. The strand cross-overs 16*a* are readily apparent in FIG. 6. At the point of laydown the strand-restraining elements 28, 29 carried by plates 25, 26 are in transverse alignment. The chains 22, 24 at each selvedge are moved at the same lineal speed. The inner chain 24 at each selvedge remains in a constant plane, while the outer chain 22 takes a devious path around sprockets 32, 34 and 36 that causes it to fall behind the inner chain by a predetermined lag distance by the time the outer chain returns to the original plane continuously occupied by the inner chain 24. This relative movement which is shown by a comparison of FIGS. 3 and 5 brings the strands into the desired orthogonal pattern shown in FIG. 7 by forming a loop in each strand along the selvedge. The excess strand material for the loop was accumulated over the support 40 then released as the outer chain 22 moved back to the original plane as it travels downward and around sprocket 36.

In precise practice, a specific sequence of N strands is engaged by the same number of strand-restraining elements 28 at a uniform strand spacing S. The strand-restraining elements 28 have a diameter of D and a pitch spacing of S. The predetermined band width W of the specific sequence also corresponds to the width of the loop along the selvedge and is equal to the product, $S(N-1)$. The preferred orthogonal pattern of uniformly spaced strands (equally spaced at all points in the useful area of the web) is attained when the process is carried out so that the lag distance L is equal to the quantity obtained by multiplying the number of strands by the spacing between adjacent strands and subtracting the diameter of one of the strand-restraining elements in accordance with the equation:

$$L=N\cdot S-D$$

Since D generally is quite small the result, for practical purposes, is orthogonal when D is not included in the equation. True orthogonal conditions are approached, with elimination of crossovers in the web, when the lag distance as defined by the above equation is increased or decreased by an incremental distance which is no greater than the spacing S. The strand crossovers are highly objectionable and their elimination is a major reason for rectification. Thus, for operation without crossovers, the process should be carried out so that the lag distance is within the range defined by the equation:

$$L=S(N\pm 1)-D$$

While the control support is indicated as a baffle plate to accumulate strand material, a moving belt traveling at an elevation near the upper edge of the support 40 could be a suitable substitute and, of course, stretch yarns can provide the necessary excess material without the need for an accumulator such as 40.

Although the traverse rectification apparatus and method have been illustrated in conjunction with the web laydown machine described in U.S. Pat. No. 4,016,631, this technology can be used in conjunction with other web laydown machines that are capable of laying down strands in an angled pattern around one or more strand-restraining elements.

I claim:

1. A method for converting a plurality of equally spaced strands cross-laid between spaced pairs of outer and inner rows of juxtaposed strand-restraining elements in an angled pattern to form a web having a predetermined width along the selvedge of the web into an orthogonal pattern, said method comprising: moving the pairs of rows at the same lineal speed; moving the outer row of each pair of rows out of the plane of travel of the inner row then back into the plane of travel of the inner row a lag distance approximately equal to said predetermined width, thereby displacing formerly juxtaposed strand-restraining elements relative to each other and permitting a portion of said strands to pass along said selvedge by sliding around displaced strand-restraining elements.

2. The method as defined in claim 1 including the additional step of accumulating the portion of said strands passing along the selvedge at a location between said spaced pairs of rows prior to moving the outer rows out of the plane of the inner rows of strand-restraining elements.

3. The method as defined in claim 1 including the step of stretching the cross-laid strands to permit said portion to pass along the selvedge.

4. The method as defined in claim 1, said plurality of equally spaced strands being cross-laid between spaced pairs of outer and inner rows of juxtaposed strand-restaining elements in sequences numbering the same as said plurality of equally spaced strands and alternating with blank spaces in an angled pattern to form a web, said lag distance being equal to the quantity obtained by multiplying the number of said plurality of equally spaced strands by the spacing between adjacent strands and subtracting a quantity equal to the diameter of one of the strand-restraining elements.

5. The method as defined in claim 4, said lag distance being increased by an incremental distance which is no greater than the spacing between adjacent strands.

6. The method as defined in claim 4, said lag distance being decreased by an incremental distance which is no greater than the spacing between adjacent strands.

* * * * *